US005473336A

United States Patent [19]

Harman et al.

[11] Patent Number: 5,473,336

[45] Date of Patent: Dec. 5, 1995

[54] CABLE FOR USE AS A DISTRIBUTED ANTENNA

[75] Inventors: Robert K. Harman, Kanata; André Gagnon, Hull, both of Canada

[73] Assignee: Auratek Security Inc., Hull, Canada

[21] Appl. No.: 158,475

[22] Filed: Nov. 29, 1993

Related U.S. Application Data

[63] Continuation-in-part of Ser. No. 957,913, Oct. 8, 1992, abandoned.

[30] Foreign Application Priority Data

Oct. 8, 1993 [WO] WIPO ..... PCT/CA93/00410

[51] Int. Cl.[6] ..... H01Q 13/20

[52] U.S. Cl. ..... 343/790; 343/770; 333/237

[58] Field of Search ..... 343/790, 791, 343/792, 767, 770, 768, 771; 333/237, 243; H01Q 13/20

[56] References Cited

U.S. PATENT DOCUMENTS

| | | | |
|---|---|---|---|
| 4,129,841 | 12/1978 | Hildebrand et al. | 333/237 |
| 4,339,733 | 7/1982 | Smith | 333/237 |
| 4,743,725 | 5/1988 | Risman | 333/237 |
| 4,887,069 | 12/1989 | Maki et al. | 333/237 |
| 4,987,394 | 1/1991 | Harman et al. | 333/237 |

FOREIGN PATENT DOCUMENTS

| | | | |
|---|---|---|---|
| 1209656 | 8/1982 | Canada | 337/57 |
| 57-21103 | 2/1982 | Japan | 333/237 |

OTHER PUBLICATIONS

Patent Abstracts of Japan vol. 6, No. 87 (E–108)(965) 25 May 1982 & JP,A 57 021 103 (Hitachi Densen) 3 Feb. 1982.

*Primary Examiner*—Donald T. Hajec
*Assistant Examiner*—Hoanganh Le
*Attorney, Agent, or Firm*—Thomas Adams

[57] ABSTRACT

A cable for use as a distributed antenna in intrusion detection systems comprises an internal open transmission line in parallel with a periodically loaded structure which supports an external transmission line mode of operation, specifically a surface wave, and is "driven" by the open transmission line. The periodically loaded structure may comprise transmission line segments for example cylindrical conductor elements intercoupled by serial inductive coupling. There are no fewer than three and no more than fifteen conductor elements in one wavelength ($\lambda_S$) of the external transmission line modes. Preferably the length of each transmission line segment is about one quarter of the wavelength ($\lambda_S$) of the external transmission line modes. The inductive coupling may be provided by resistance wires extending alongside the conductor elements. The open transmission line may comprise a two-wire line and the transmission line segments two arrays of conductor elements, associated with respective ones of the two wire. Alternatively, the open transmission line may be an open coaxial cable and the transmission line segments a series of cylinders surrounding the coaxial cable.

24 Claims, 4 Drawing Sheets

CABLE FOR USE AS A DISTRIBUTED ANTENNA

This is a continuation-in-part of application Ser. No. 07/957,913 filed Oct. 8, 1992 now abandoned.

FIELD OF THE INVENTION

This invention relates to cables for use as distributed antennas for the reception and/or transmission of radio frequency signals. The invention is especially applicable to such cables for use in intrusion detection systems and communication systems for mines, tunnels and the like.

BACKGROUND

Various types of cable have been used as distributed antennas. Two wire lines have been used in mines and tunnels as leaky feeder lines for communications, but have not found wide application because virtually all of their electromagnetic field propagates in the space around the cable and so is susceptible to environmental effects. Surface wave lines, such as Goubau lines, provide surface wave fields which are bound more tightly to the cable than those of a two-wire line but still are unduly susceptible to environmental effects. Leaky waveguides are less susceptible to environmental effects because their fields propagate almost entirely within the waveguide, but are generally limited to frequencies above several Gigahertz due to physical dimension constraints.

Distributed antennas in the form of leaky coaxial cables have been disclosed. Such leaky coaxial cables typically comprise a central conductor embedded in a dielectric material which is surrounded by one or more shields. Apertures in the shield(s) allow radio frequency energy to penetrate the shield(s) in a controlled manner. The size, shape and orientation of the apertures determine whether the cable supports a surface wave or a leaky wave mode of operation. Thus, in a paper entitled "Various Types of Open Waveguide for Future Train Control", Sumitomo Elect. Tech. Rev, June 1968 , Tsuneo Nakahara et al disclose a first open coaxial cable with numerous closely spaced apertures or a longitudinal slot for surface wave modes and a second open coaxial cable with zig-zag slots spaced at intervals of about one wavelength for conveying leaky wave modes.

Leaky coaxial cables used in intrusion detection systems preferably set up an electromagnetic field around the cable which decays rapidly with radial distance. This rapid decay rate is very desirable for a cable to be used as a distributing antenna in an intrusion detection system because it provides a well-defined detection zone. An intruder moving in proximity to the cable, say within one meter, disturbs the electromagnetic field coupling the cable and is thereby detected, whereas a person or vehicle moving sway, will not be detected.

The electromagnetic field produced by such a cable is the sum of the field produced by each aperture taking into account all external modes of propagation, including radiation away from the cable and transmission line along the cable. The attenuation and velocity of propagation of the transmission line modes are highly dependent upon the medium surrounding the cable. A disadvantage of leaky coaxial cable is its susceptibility to mode cancellation effects when the cable is used in a low loss environment such as when it is mounted in air. If the cable is mounted in air, transmission line modes propagate at almost the velocity of free space and with minimal attenuation. On the other hand, if the cable is buried in soil, the transmission line mode propagates relatively slowly and with considerable attenuation. Hence, in a low loss soil such as dry sand, perhaps 95% of the field at a given distance from the cable will be due to approximately 10 meters of cable, while in heavy clay it might be due to less than 1 meters of cable. Hence, the field at a given distance from the cable will decrease rapidly as soil loss is increased. Consequently, buried leaky coaxial cable sensors are very susceptible to soil conditions and environmental conditions.

If a leaky coaxial cable is laid on the soil surface or mounted parallel to the soil surface or another conductor, for example a wire fence, mode cancellation effects may be experienced due to "image line" fields being set by in the soil or other conductor. Also, discontinuities in the field of the image line can cause reflections which cause radiation and standing waves, further corrupting the transmission line mode. The end result is a very erratic external field which is strongly influenced by its surroundings and physical motion of the cable relative to the soil or other conductor. As a result of these problems, the use of leaky coaxial cable sensors has been generally limited to buried applications where the attenuation of the externally propagating surface wave is sufficient to prevent mode cancellations.

In order to overcome these disadvantages, it has been proposed in European patent application No. EP 0,322,128, and United States equivalent U.S. Pat. No. 4,987,394, to provide a special helical winding of fine steel wires on the outside of the outer shield of the leaky coaxial cable. In effect, the resistive properties of the helical outer conductor have the same effect as if the cable were buried in a lossy medium. While this cable offers advantages over other leaky coaxial cables, it is inherently expensive to manufacture and not entirely satisfactory because the magnetic field lines of the helical winding are not compatible with an axially cylindrical surface wave. The cable described in EP 0,322,128 would support a multiplicity of radiating and propagating modes and hence not be entirely suitable for use in air. In one embodiment, EP 0,322,128 also discloses forming the shield as a plurality of discrete sleeve elements overlapping each other in fishscale fashion. The predominantly capacitive coupling between these overlapping sleeve elements would tend to speed up transmission line mode propagation, which would exacerbate the problem by causing leaky wave radiation.

SUMMARY OF THE INVENTION

The present invention seeks to eliminate, or at least mitigate, the disadvantages of the prior art.

According to the present invention there is provided a cable, suitable for use as a distributed antenna, comprising an internal open transmission line and a plurality of identical transmission line segments spaced apart along the length of the cable to form a periodically loaded structure surrounding the open transmission line, the periodically loaded structure and the line being coupled electromagnetically for distributed coupling of radio frequency signals from one to the other, the cable further comprising coupling means interconnecting adjacent transmission line segments resistively and inductively such that the periodically loaded structure supports external transmission line modes having a velocity of propagation less than that of free space, and the attenuation of the external modes is greater than that of signals propagating along the internal open transmission line.

If the cable, in use, is suspended, in air, away from a ground plane or other conductor, the transmission line mode will comprise a predominant surface wave. On the other hand, if the cable is located, in use, adjacent a ground plane or other conductor, the transmission line mode will comprise a surface wave and an image line.

In this specification, the term "periodically loaded structure" is used for a structure formed by a plurality of identical sections of uniform transmission line separated from one another by thin obstacles and exhibiting pass band/stop band characteristics as well as supporting waves with phase velocities other than the velocity if the obstacles were removed.

The internal open transmission line may comprise a slotted coaxial cable, twin lead or other suitable transmission line which is not completely shielded and so will couple with the periodically loaded structure throughout its length, either continuously or at suitable intervals.

Where the open transmission line comprises a two-wire line, the transmission line segments may comprise two diametrically opposed longitudinal arrays of conductor elements, each element being slightly less than a semi-cylinder so that the two arrays define a cylindrical shield with diametrically opposed longitudinal slots along opposite side of the dielectric. In each array, the conductor elements are spaced apart to define circumferential slits of a width which is very small compared to the length of each element. The conductor elements of one array are displaced longitudinally relative to those of the other array by one half of the length of a conductor element. Hence the circumferential slits between the elements of one array do not align with the circumferential slits between elements of the other array. Preferably, there are four elements per prescribed wavelength of the external transmission line mode.

In one preferred embodiment of the invention the dielectric material is elliptical in cross section and the conductor elements are disposed diametrically opposite each other and the open transmission line comprises two conductors each at a minor focus of the ellipse and a corresponding cone of the arrays.

Alternatively, where the open transmission line comprises a slotted coaxial cable comprising a central conductor, surrounding dielectric and a cylindrical shield having a longitudinal slot, the array of transmission line segments may comprise a series of cylinders of conductive material spaced along the length of the cable.

In any of the afore-mentioned embodiments of the invention, the coupling means providing the inductive and resistive coupling between adjacent transmission line segments may comprise one or more resistance wires or conductors extending longitudinally of the cable, preferably in proximity and parallel to the transmission line segments. The wires may be embedded in a surrounding protective sleeve. Preferably the wires have a small diameter (say 0.30 mm.) and are of a material having a relatively high resistivity, for example ferritic stainless steel with a resistivity of about 60 microhm-cm.

BRIEF DESCRIPTION OF DRAWINGS

Various objects, features and advantages of the invention will become apparent from the following description of embodiments of the invention, which are described by way of example only and with reference to the accompanying drawings in which.

BEST MODE(S) FOR CARRYING OUT THE INVENTION

A cable embodying the invention may be used as a receiving antenna or a transmitting antenna. As a receiving antenna, its performance would be described in terms of sensitivity to a radio frequency signal coupled by external electromagnetic fields. As a transmitting antenna, its performance would be described in terms of the external electromagnetic field set up when a radio frequency signal propagates along the internal open transmission line. Since the two modes of operation are reciprocal, and to simplify description, operation of the cable as a transmitting antenna only will be described in the following description.

Figure 1:
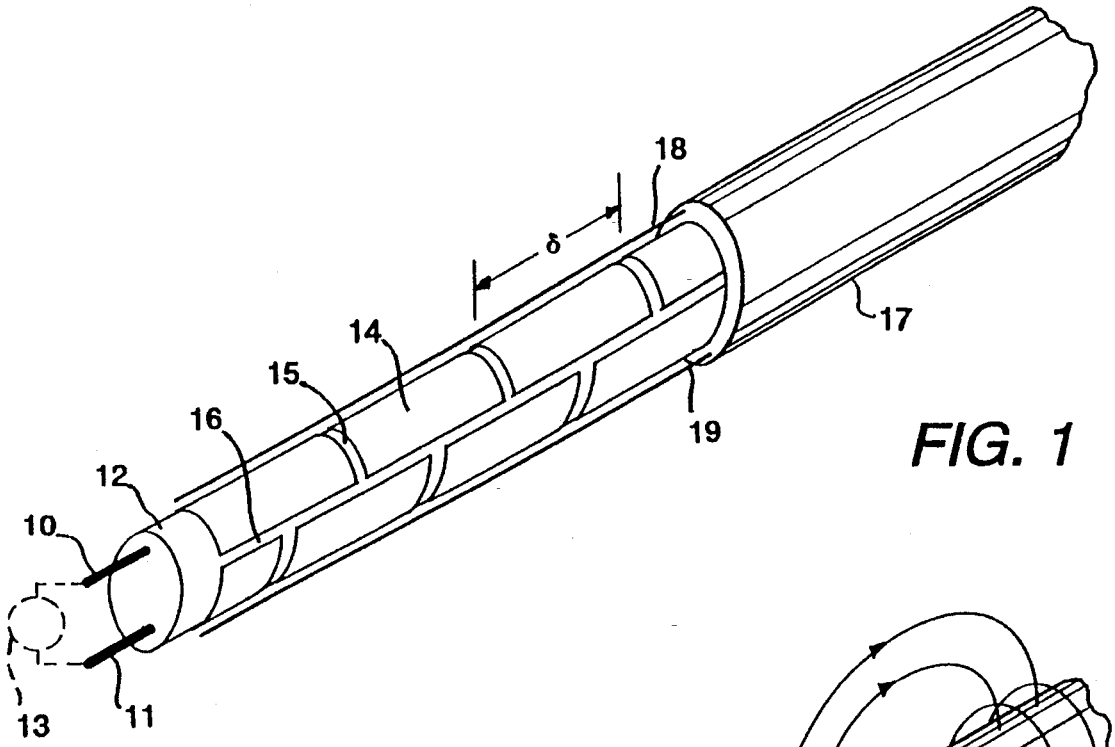
FIG. 1 is a cut away perspective view of a cable according to one embodiment of the invention.

FIG. 1 illustrates a cable for use as a distributed antenna in an intrusion detection system operating in the commercial FM radio band of frequencies from 88 to 108 MHz. The cable comprises an internal open transmission line formed by two parallel conductors 10 and 11, respectively, embedded in a dielectric material 12 of elliptical cross sectional shape. The conductors 10 and 11 are located approximately at the respective foci of the ellipse and are shown connected to a radio frequency source 13 which, in this preferred embodiment, applies a radio frequency signal of 98 MHz. to the conductors 10 and 11. (For use as a receiving distributing antenna, the conductors 10 and 11 would be connected to a receiver.) The open transmission line formed by conductors 10 and 11 and dielectric 12 is available commercially as Belden No. 9085 TV twin lead. The conductors 10 and 11 each comprise seven strands of number 30 AWG copper covered steel wires, giving an effective diameter of 22 AWG. The dielectric material 12 is cellular polyethylene which has a relative dielectric constant of 1.6 , so that the propagation velocity for the line is about 80 per cent of that of free space. The conductors 10 and 11 are nominally 6.9 mm. apart and the dielectric 12 is nominally 10.03 by 3.40 mm. on its major and minor axes, respectively.

The dielectric material 12 is surrounded by a periodically loaded structure formed by two diametrically-opposed arrays of transmission line segments, each array adjacent a different one of the conductors 10 and 11. Each transmission line segment comprises a conductive shield element 14 bonded to the external surface of dielectric 12.

The conductor elements 14 are made from an aluminum/polypropylene foil tape thermally bonded to the surface of the cellular polythene dielectric 12. A suitable tape is marketed under the trade mark Neptape P26 by Neptco Inc. and comprises a polypropylene film sandwiched between two aluminum foils with a fusible film on one of the aluminum foils suitable for bonding to polythene. Adjacent conductor elements 14 are separated by narrow circumferential slits 15. The slits 15 are narrow relative to the length of the conductor elements 14 to limit egress of the electric field. Thus, for an operating frequency of 98 MHz., the length $\delta$ of the conductor elements 14 will be about 0.69 meters and the slits 15 about 2 to 3 mms. wide. The conductor elements 14 are slightly less than a semi-ellipses so that edges of the conductor elements of the different arrays define axial slots 16 in the middle of the major surfaces of the dielectric 12 (only one slot 16 is shown).

The conductor elements 14 are surrounded by a solid polyethylene jacket or sleeve 17 about 1 mm. thick. The external jacket 17 is very thin relative to the wave length of the 98 MHz. signal so it has little effect upon the coupling between the internal transmission line 10/11 and the periodically loaded structure of conductor elements 14. Likewise, dielectric loading of the periodically loaded structure of conductor elements 14 by the jacket 17 is minimal.

Embedded in the jacket or sleeve 17, conveniently during extrusion, are two axial resistance wires 18 and 19, extending adjacent to each array on the major diameter of the elliptical cross section. The wires 18 and 19 are 0.30 mm. and are spaced from the conductor elements by about 0.381 mm. The wires 18 and 19 are Type 430 Ferritic stainless steel with a resistivity of 60 microhm-cm. Hence, the 0.30 mm. diameter wires 18 and 19 have a D.C. resistance of about 8 ohms per meter. Since Type 430 ferritic stainless steel is magnetic, its magnetic permeability limits the skin depth for VHF signals thereby increasing its resistance and hence the attenuation of the external transmission line modes of propagation.

In essence, the two arrays of conductor elements 14 are the equivalent of the usual shield cut into two equal and symmetrical halves by longitudinal slots, one on each side of the cable. Of themselves, these longitudinal slots do not disrupt current flow and hence do not cause magnetic coupling to the outside of the cable. Because the longitudinal slots are located midway between conductors 10 and 11 they cause minimal electric field coupling to the outside of the cable by or from those conductors. The circumferential cuts or slots 15, however, disrupt current flow and cause magnetic coupling to occur. The periodically loaded structure formed by conductor elements 14 and wires 18 and 19, supports a transmission line mode of propagation, specifically an axially cylindrical surface wave. The wires 18 and 19 inductively couple adjacent conductor elements 14 of the adjacent array. The resistive nature of the coupling causes the surface wave to attenuate as it propagates along the length of the cable. The surface wave attenuation exceeds the attenuation of the internal transmission line 10/11. Consequently, in transmitter mode, the open transmission line 10/11 "drives" the external surface wave. Hence, rather than propagating at its natural velocity and with its natural attenuation, the surface wave appears to propagate with the velocity and attenuation associated with the internal transmission line formed by conductors 10 and 11.

Figure 2:
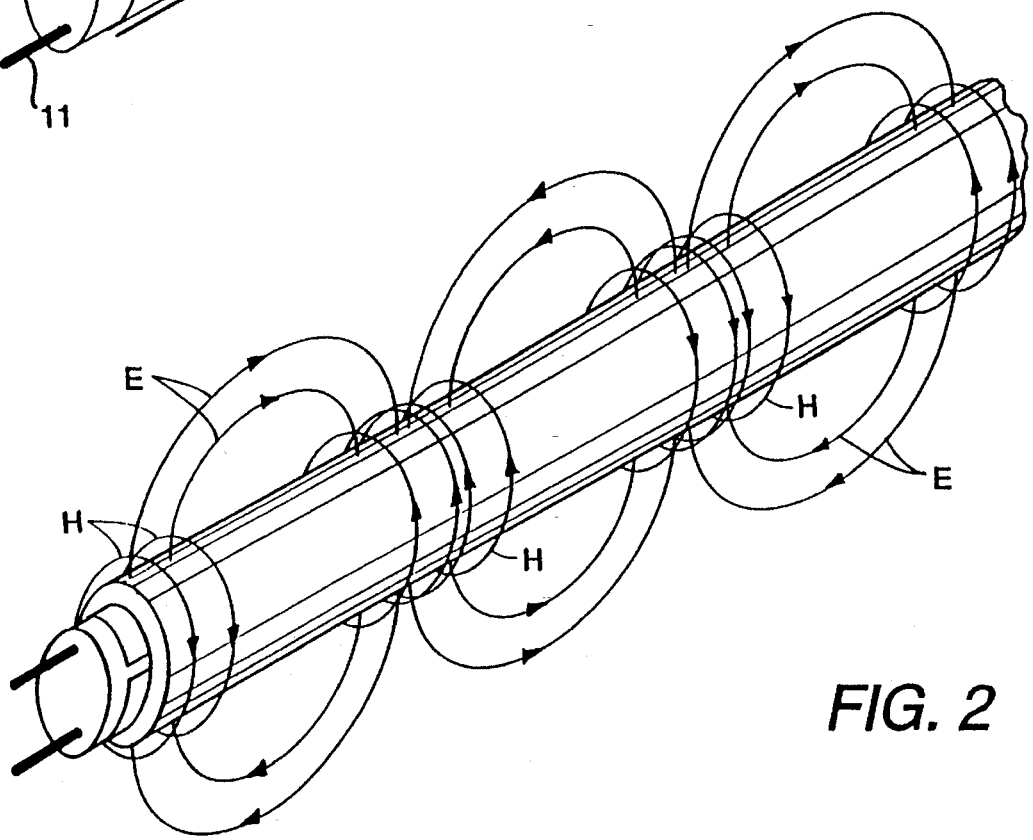
FIG. 2 illustrates surface wave mode operation when the cable is energized by an appropriate source.

The electric and magnetic field lines associated with the axially cylindrical surface wave are illustrated in FIG. 2. The magnetic field lines H are circumferential around the axis of the cable. The electric field lines E emanate radially from the surface of the cable and curve in the direction of the cable axis to penetrate the surface of the cable one half wavelength (i.e. $\lambda_S$ at the surface wave velocity) further along its length. The further the electric field lines E extend before returning to the cable the more loosely bound the electric field is said to be.

Figure 3:
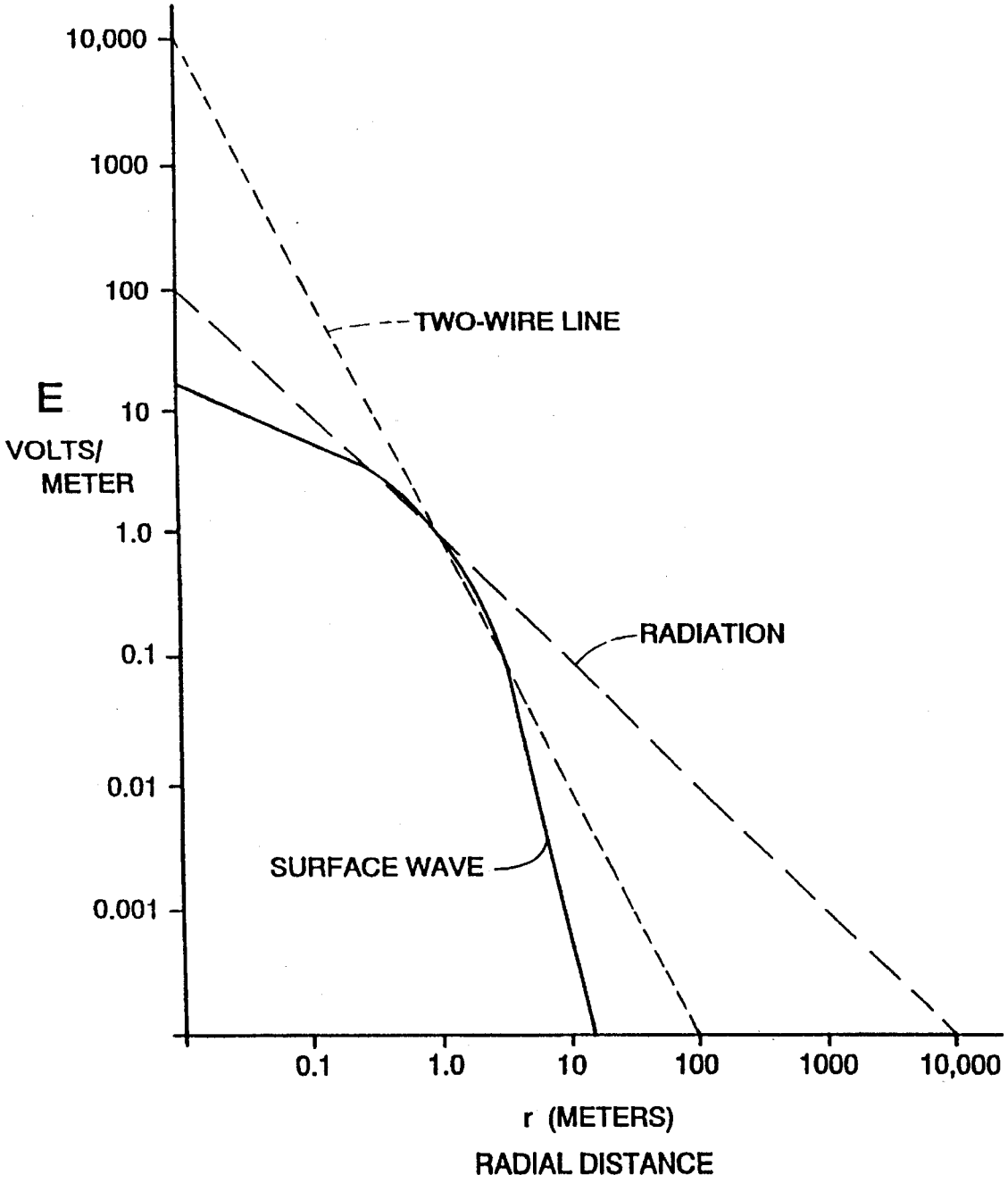
FIG. 3 illustrates radial decay of the surface wave as compared with the field to a two-wire line, or radiation.

FIG. 3 illustrates the radial decay, in volts per meter, of the electric fields for a surface wave, a two wire line and radiation, respectively, normalized to pass through one volt per meter at one volt per radial distance. The two-wire line field, normally called an induction field, decays as $1/r^2$, radiation from the antenna decays as $1/r$ and the surface wave field decays as a Hankel function of order one. For small values of r, the Hankel function decays as $1\sqrt{r}$ and for larger values of r decays as $$\frac{e^{-br}}{\sqrt{br}}$$

which, for the practical embodiment described, approximates to give a decay factor $$b=\sqrt{\beta_s^2-\beta_0^2},$$

where $\beta_0$ is the free space wave length and $\beta_S$ is the wave length factor associated with the surface wave line. The surface wave decay function illustrated in FIG. 3 is for a surface wave velocity of 0.95 times that of the free space and a frequency of 98 MHz.

The size of the radial field can be modified to fit a particular application by controlling the velocity of propagation of the surface wave. The slower the surface wave the larger the decay factor b and the more tightly the field is bound to the cable. In the embodiment shown in FIG. 1, the velocity of the surface wave is determined by the inductive loading of the transmission line segments 14 by the drain wires 18 and 19 and can be altered by changing the spacing, size and/or resistance of the wires 18 and 19.

Figure 4:
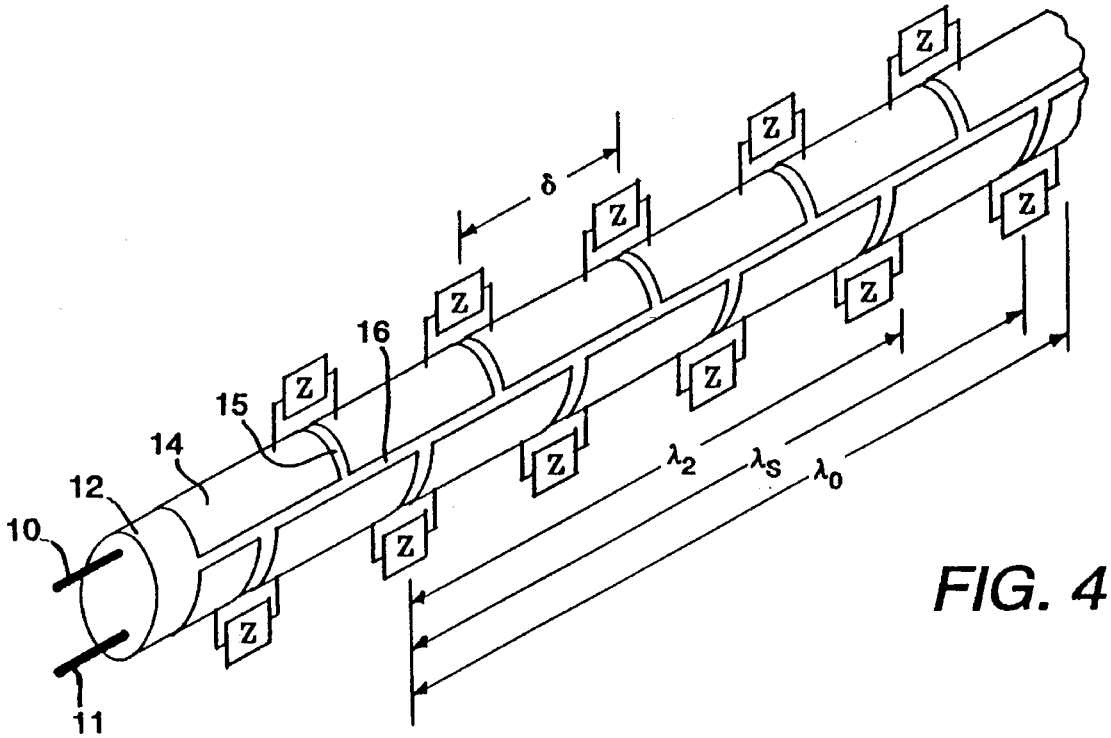
FIG. 4 illustrates the cable of FIG. 1 with its outer sleeve removed and showing lumped impedances coupling adjacent segments.

FIG. 4 shows the cable with the outer jacket 17 removed and with the inductive-resistive coupling between the conductor elements 14, due to wires 18 and 19, depicted by discrete impedances Z. The offset between the conductor elements 14 on one side of the cable relative to those on the other side (shown as one half of the conductor element length $\delta$) controls the degree of coupling between the internal transmission line 10/11 and the periodically loaded structure itself. The periodically loaded line will support the desired external transmission line or surface wave mode of propagation over specific frequency passbands.

The internal two wire line formed by conductors 10 and 11 is shielded by the array of conductor elements 14 and will support two basic modes of wave propagation; balanced and unbalanced. In the balanced mode, the instantaneous currents in conductors 10 and 11 at any location along the cable are equal in amplitude but opposite in direction. In the unbalanced mode the instantaneous currents in conductors 10 and 11 at any location along the cable are equal in amplitude with the same direction and with the return path being in the shield.

In both the unbalanced and balanced modes propagation, the dielectric constant of dielectric material 12 is the major factor in determining the velocity of propagation for the line 10/11. In general, for a 100 per cent shielded twin lead, the velocity of propagation is that of a plain wave in free space divided by the square root of the relative dielectric constant of dielectric material 12. For the cable illustrated in FIGS. 1 and 4, the inductive loading of outer conductor elements 14 also tends to slow down both the balanced and unbalanced modes of propagation on the inner transmission line 10/11. As a result, the velocity of propagation in the internal open transmission line 10/11 will be about 0.76 that of free space. The corresponding wavelength $\lambda_2$ for the source frequency of 98 MHz. is illustrated in FIG. 4.

The balanced mode of propagation on conductors 10 and 11 provides a relatively low loss means of conveying signals along the length of the cable. Very little of the balanced mode couples to the outside world, since it is principally contained inside the periodically loaded structure and not directly effected by the outside environment. Also because the circumferential slits 15 of the two arrays are asymmetrical, energy flowing in the balanced mode is converted into unbalanced currents causing coupling to the outside world. It will be appreciated that the circumferential slits 15 between conductor elements 14 disrupt the unbalanced current causing magnetic flux linkage via the wires 18 and 19. Substantially all of the unbalanced mode carried in parallel by conductors 10 and 11, returns via the periodically loaded structure comprising the conductor elements 14 and inductive-resistive couplings provided by the wires 18 and 19.

Usually, the two wire internal transmission line 10/11 will be fed by a 100 per cent shielded twin lead feeder. In order to avoid problems with unbalanced modes in the feeder, it has been found desirable to use a quarter wave stub at the interface between the twin lead feeder and the wires 10 and 11. A short circuit on the balanced line and an open circuit on the unbalanced line at the end of the quarter wave stub produce an open circuit on the balanced line and a short circuit on the unbalanced line at the start of the internal open transmission line. This ensures that there is 100 per cent coupling of the balanced modes from the feeder cable to the internal open transmission line, while effectively blocking unbalanced coupling.

The surface wave velocity is assumed to be 0.95 that of free space as indicated by the representations of surface wave wavelength $\lambda_S$ and free-space wavelength $\lambda_O$ in FIG. 4.

In use, the external surface wave is frequency dependent, since the periodically loaded structure exhibits pass bands and stop bands as a function of frequency. Such passband/stopband characteristics are described in detail in Chapter 8 entitled "Periodically Loaded Lines" of the text book "Lossy Transmission Lines" by Fred E. Gardiol, 1987. When operating in the pass bands, the coupling impedances Z provided by the wires 18 and 19 provide the necessary inductive loading to create a slow wave structure. If operating in the stop bands, each section of line between the slits 15 would resonate and no surface wave would be supported. The cable would simply radiate its coupled energy as a leaky wave or as a linearly distributed phased array.

For the cable shown in FIGS. 1 and 4 the first stop band occurs when the length $\delta$ of the conductor elements 14 is approximately one half of the surface wave length $\lambda_S$. Since the length $\delta$ of conductor elements 14 is less than one half wave length $\lambda_S$, the cable operates in the first pass band. In addition to determining operation within the first pass band, the periodically loaded structure also supports unidirectional coupling. In other words, signals travelling in one direction on the internal transmission line 10/11 couple to a surface wave travelling in the same direction on the surface of the cable. Generally such unidirectional coupling is achieved when:

$$\delta = \frac{\pi}{\beta_s + \beta_2}$$

where βhd Sand $\beta_2$ are the wave length phase factors for the external surface wave and the inner transmission line, respectively. Preferably this condition is met at the center of the desired frequency band of operation.

Generally, the lengths $\delta$ of the conductor elements 14 should be such that there are no fewer than three, or more than fifteen, conductor elements 14 per wavelength $\lambda_S$ of the surface wave, i.e. the length of each transmission line segment should be between about one third and about one fifteenth of the wave length $\lambda_S$ of the external surface wave or external transmission line modes.

If there are more than fifteen conductor elements per wavelength, they can no longer be considered transmission line segments and the periodically loaded structure will no longer exhibit the required pass band/stop band characteristics required to slow down and hence bind the surface wave to the cable. On the other hand, if the transmission line segments are too long, say less than three conductor elements per wavelength, they will not operate as a periodically loaded structure. Within each frequency passband of operation, the maximum reduction in phase velocity occurs at the high end of the band just before the next stop band. Taking the inside and outside velocities into account, it has been found that satisfactory directional coupling can be achieved when the length $\delta$ of conductor elements 14 is approximately one quarter (25%) of the wavelength $\lambda_S$. Hence, as shown in FIG. 4, the periodically loaded structure has four conductor elements 14 per wavelength $\lambda_S$ of the surface wave. Hence a signal travelling along the inner transmission line 10/11 causes a wave to travel in the same direction on the surface wave line or periodically loaded structure with minimal backwards coupling for travelling wave. This directional coupling prevents the formation of a standing wave on the periodically loaded structure.

The present invention encompasses various alternatives and modifications. In the alternative embodiment shown in FIG. 5, the open transmission line takes the form of a slotted coaxial line comprising a central conductor 50, a cylindrical dielectric 51 and surrounding slotted cylindrical shield 52. The shield 52 is continuous except for a single longitudinal slot 53. The shield 52 is itself surrounded by a dielectric material 54, which corresponds to the dielectric 12 of the FIG. 1, and which is itself surrounded by an array of conductor elements 55. The conductor elements 55 differ from conductor elements 16 of the FIG. 1 embodiment in that they comprise complete cylinders. The conductor elements 55 are surrounded by a protective outer jacket 56 in which is embedded a wire 57 corresponding to one of the wire 18 and 19 of FIG. 1 and serving the same function.

In this case the transmitter or receiver 13 is coupled between the central conductor 50 and the shield 52. As before, the conductor elements 55 are separated by small circumferential slits 58 and rely upon inductive coupling by way of the conductor 57 to function as a periodically loaded structure and support a surface travelling wave.

The cable of FIGS. 1 and 4, with its two arrays of conductors 14 staggered by as much as one half their length, affords accurate computation of intruder location but the relatively high attenuation of its inner open transmission line may constrain its use to situations where signal-to-noise ratio is particularly good and/or the cable is relatively short. The attenuation of the open transmission line can be reduced by reducing the distance by which the arrays are staggered, even to the extent that circumferential slits 15 are aligned. At that point, the axial slot 16 could be omitted. The resulting cable would then comprise a two-wire transmission line similar to that shown in FIGS. 1 and 4 with a periodically loaded structure similar to that shown in FIG. 5.

Figure 5:
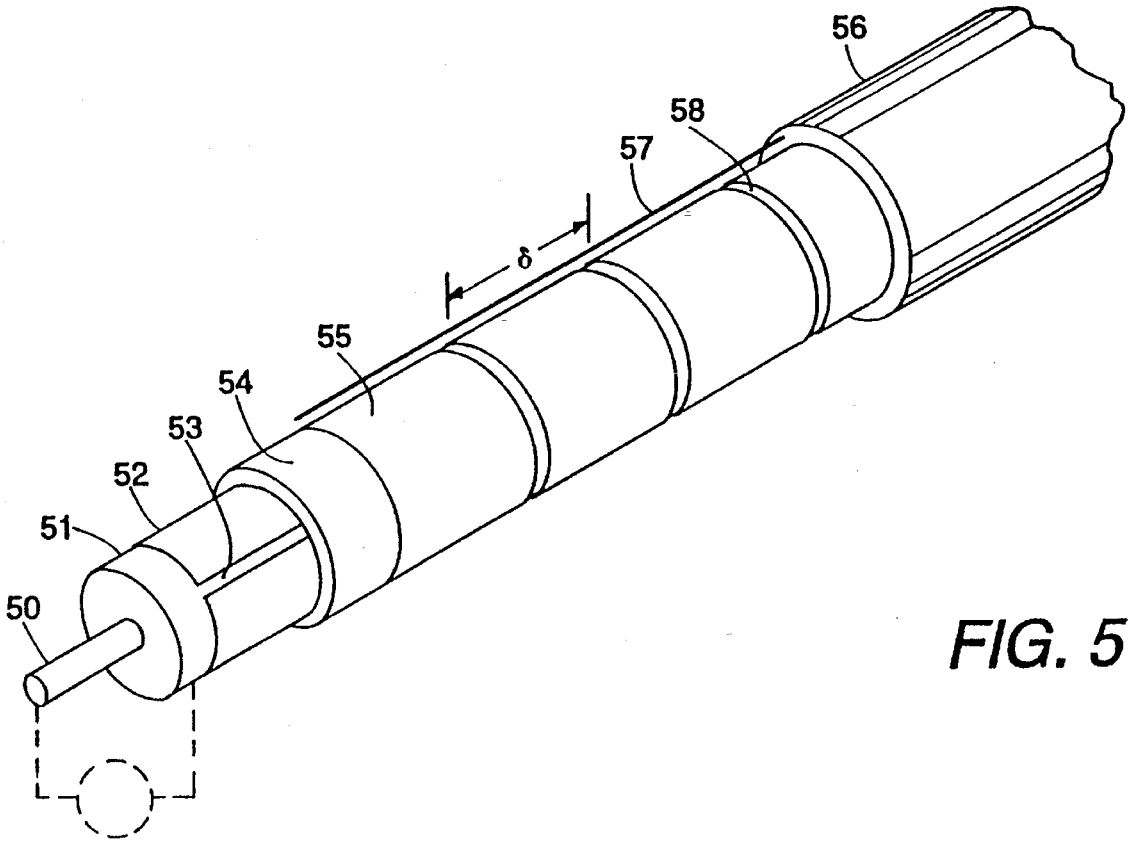
FIG. 5 illustrates a second embodiment of the invention.
Figure 6:
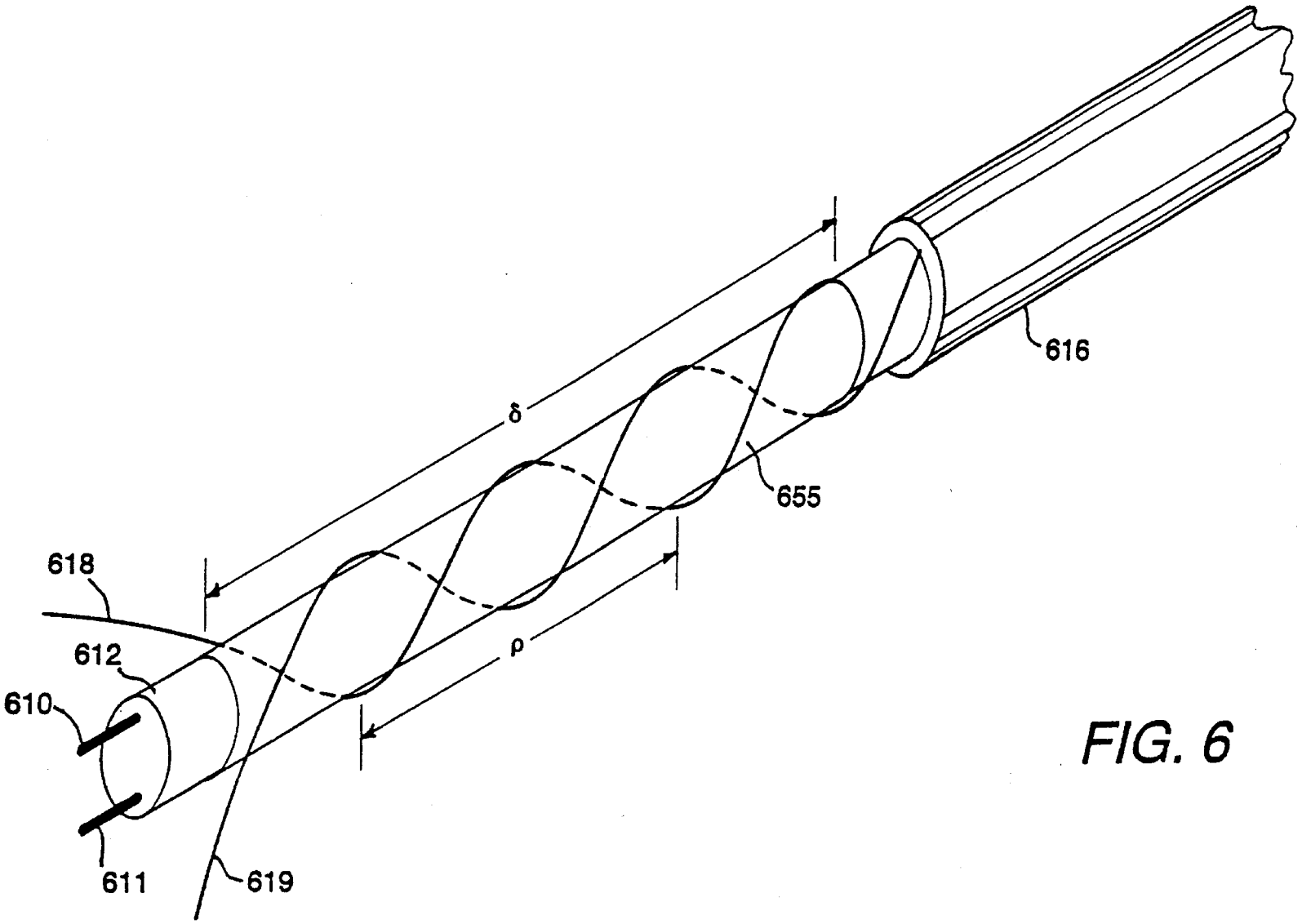
FIG. 6 illustrates a third embodiment of the invention.

Such an arrangement is shown in FIG. 6, in which the inner open transmission line comprises two conductors 610 and 611 embedded in a dielectric material 612 of elliptical cross section. The periodically loaded structure comprises a series of conductive cylinders 655 spaced apart along the exterior of the dielectric material 612. The conductive cylinders 655 are surrounded by an outer protective jacket 616 similar to outer jacket 56 of FIG. 5. A pair of resistance wires 618 and 619 extend alongside the cylinders 655 between them and the polyethylene outer jacket 616 which is applied over the wires 618 and 619. The resistance wires may made of the same material as resistance wires 18 and 19 of FIG. 1 but, in the embodiment of FIG. 6, they are not parallel to the longitudinal axis and are not within the outer jacket 616. Instead, they are wound helically around the cylinders 655, one wire forming a right-hand helix and the other wire a left-hand helix. Each wire has a thin covering of polyvinylchloride insulation (PVC). Because the PVC does not adhere to the polyethylene jacket 616, the resistance wires 618 and 619 can move relative to the cylinders 655 and the outer jacket 616 when the cable is flexed. This reduces the risk of the wires breaking in use. In this case, the spacing of the wires 618/619 from the cylinders 655 is determined by their PVC coating.

The cylinders 655 are similar to the cylinders 55 of FIG. 5, but about 0.76 meters long with spacing slits of about 3 mm. It should be noted that in this and other embodiments, the slits of 2 or 3 mm. are small so as to avoid too much signal coupling through them while limiting capacitive coupling between cylinders. Only one cylinder 655 is shown in FIG. 6. To simplify the drawing, FIG. 6 shows only two turns of each resistance wire 618/619 per cylinder 655. In practice, however, the pitch $\rho$ of each helix is likely to be much less than half of the cylinder length $\delta$. A suitable ratio, for one working embodiment, was found to be 7.5 turns per cylinder.

It should be appreciated that helical resistance wires are not limited to use with the embodiment of FIG. 6 but could be used instead of parallel wires in other embodiments of the invention. In each case, however, the slight increase in electrical length of the coupling from the wires to the conductor elements should be taken into account.

It should be noted that the desired mode of operation is achieved when the resistive component of the periodic impedances of the periodically loaded structure is greater than the attenuation of the internal transmission line 10/11 or 50/52.

It should be appreciated that although the wires 18,19/57/618,619 are a simple and economical way of providing inductive coupling with easily controlled resistivity, it would be possible to use discrete components to couple adjacent segments.

Cables according to the present invention effectively continually set up a field which looks and behaves like a surface wave in that it appears to propagate at exactly the cable velocity regardless of the external environment. This maintains the rapid radial decay of a surface wave while avoiding many of the problems associated with known leaky cables.

It is envisaged that embodiments of the invention could be modified, to make them into graded cables, by making the slits 15 or 58 progressively narrower along the length of the cable.

Although cables embodying the present invention are particularly suitable for use in intrusion detection systems, it is envisaged that they could also be used in mines or along railway tracks, or any other situation where it is desirable to limit the effective field to the immediate vicinity of the cable.

Although embodiments of the invention have been described and illustrated in detail, it is to be clearly understood that the same is by way of illustration and example only and is not to be taken by way of the limitation, the spirit and scope of the present invention being limited only by the appended claims.

What is claimed is:

1. A cable, suitable for use as a distributed antenna, comprising an internal open transmission line and a plurality of identical transmission line segments spaced apart along the length of the cable to form a periodically structure surrounding the open transmission line, the periodically loaded structure and the line being coupled electromagnetically for distributed coupling of radio frequency signals from one to the other, the cable further comprising coupling means interconnecting adjacent transmission line segments resistively and inductively such that the periodically loaded structure supports external transmission line modes having a velocity of propagation less than that of free space, and attenuation of external modes is greater than that of signals propagating along the internal open transmission line.

2. A cable as claimed in claim 1, wherein the open transmission line comprises a two wire line formed by two parallel conductors surrounded by a dielectric material, and the periodically loaded structure comprises a first array of said transmission line segments disposed along the surface of the dielectric adjacent one of the two conductors and a second array of said transmission line segments disposed along a diametrically opposite surface of the dielectric, such transmission line segments comprising conductor elements of generally semi-cylindrical shape, each slightly less than half of the circumference of the dielectric surface, such that the two arrays define two longitudinal slots extending diametrically opposite one another, the conductor elements of one array being offset longitudinally relative to the conductor elements of the other array.

3. A cable as claimed in claim 2, wherein the conductor elements of one array are displaced relative to the conductor elements of the other array by substantially one half of the length of a said conductor element.

4. A cable as claimed in a claim 2, wherein the coupling means comprises lumped impedances (Z).

5. A cable as claimed in claim 1, wherein the length of each transmission line segment is between one third and one fifteenth of the wavelength of the external transmission line modes.

6. A cable as claimed in claim 5, wherein the length of each transmission line segment is about one quarter of the wavelength of the external transmission line modes.

7. A cable as claimed in claim 1, wherein the coupling means comprises at least one resistance wire extending parallel to the transmission line segments and spaced therefrom a predetermined distance.

8. A cable as claimed in claim 7, wherein the at least one resistance wire is wound helically around the transmission line segments and insulated therefrom.

9. A cable as claimed in claim 1, wherein the internal open transmission line comprises a slotted coaxial line, the cable further comprises a dielectric material surrounding the slotted coaxial line, and the periodically loaded structure comprises a plurality of identical cylindrical conductor elements spaced apart along the cable and surrounding the dielectric material, the spacing between the conductor elements being significantly less than the length of each conductor element.

10. A cable as claimed in claim 9, wherein the length of each transmission line segment is between one third and one fifteenth of the wavelength of the external transmission line modes.

11. A cable as claimed in claim 10, wherein the length of each transmission line segment is about one quarter of the wavelength of the external transmission line modes.

12. A cable as claimed in claim 9, wherein the coupling means comprises at least one resistance wire extending parallel to the conductor elements and spaced therefrom a predetermined distance.

13. A cable as claimed in claim 12, wherein the at least one resistance wire is wound helically around the conductor elements and insulated therefrom.

14. A cable as claimed in claim 9, wherein the coupling means comprises two resistance wires wound helically around the conductor elements and insulated therefrom, one conductor forming a right-hand helix and the other forming a left-hand helix.

15. A cable as claimed in claim 9, wherein the coupling means comprises lumped impedances (Z).

16. A cable as claimed in claim 1, wherein the coupling means comprises two resistance wires wound helically around the transmission line segments and insulated therefrom, one conductor forming a right-hand helix and the other forming a left-hand helix.

17. A cable as claimed in claim 1, wherein the open transmission line comprises a two wire line formed by two parallel conductors surrounded by a dielectric material, the periodically loaded structure comprises a plurality of identical cylindrical conductor elements spaced apart along the cable and surrounding the dielectric material, the spacing between the conductor element being significantly less than the length of each conductor element, and the coupling means comprises at least one resistance wire extending helically around the conductor elements and spaced therefrom a predetermined distance.

18. A cable as claimed in claim 17, wherein the length of each transmission line segment is between one third and one fifteenth of the wavelength of the external transmission line modes.

19. A cable as claimed in claim 18, wherein the length of each transmission line segment is about one quarter of the wavelength of the external transmission line modes.

20. A cable as claimed in claim 17, wherein the coupling means comprises at least one resistance wire extending parallel to the conductor elements and spaced therefrom a predetermined distance.

21. A cable as claimed in claim 20, wherein the at least one resistance wire is wound helically around the conductor elements and insulated therefrom.

22. A cable as claimed in claim 17, wherein the coupling means comprises two resistance wires wound helically around the conductor elements and insulated therefrom, one conductor forming a right-hand helix and the other forming a left-hand helix.

23. A cable as claimed in claim 17, wherein the coupling means comprises lumped impedances (Z).

24. A cable as claimed in claim 1, wherein the coupling means comprises lumped impedances (Z).

* * * * *